US005326275A

United States Patent [19]

Murakami

[11] Patent Number: 5,326,275

[45] Date of Patent: Jul. 5, 1994

[54] CONNECTING METHOD AND A CONNECTOR FOR FLEXIBLE PLANAR CONDUCTOR CABLES

[75] Inventor: Koji Murakami, Mie, Japan

[73] Assignee: Sumitomo Wiring Systems, Ltd., Mie, Japan

[21] Appl. No.: 928,302

[22] Filed: Aug. 12, 1992

[30] Foreign Application Priority Data

Aug. 13, 1991 [JP] Japan ..... 3-228903

[51] Int. Cl.[5] ..... H01R 31/08

[52] U.S. Cl. ..... 439/189; 439/507

[58] Field of Search ..... 439/67, 77, 49, 189, 439/49, 52, 516, 507, 493, 511-513

[56] References Cited

U.S. PATENT DOCUMENTS

| | | | |
|---|---|---|---|
| 3,417,362 | 12/1968 | Reynolds | 439/744 |
| 4,384,755 | 5/1983 | Perretta | 439/189 |
| 4,593,959 | 6/1986 | Simms | 439/516 |
| 4,640,562 | 2/1987 | Shoemaker . | |
| 4,950,169 | 8/1990 | Martin et al. | 439/44 |
| 5,061,196 | 10/1991 | Weston et al. | 439/49 |

FOREIGN PATENT DOCUMENTS

| | | |
|---|---|---|
| 0213735 | 7/1986 | European Pat. Off. . |
| 0437296 | 7/1991 | European Pat. Off. . |
| 4474905 | 8/1969 | Japan . |
| 83/03717 | 10/1983 | PCT Int'l Appl. . |
| 1398777 | 6/1975 | United Kingdom . |
| 1497277 | 1/1978 | United Kingdom . |
| 2199196 | 6/1988 | United Kingdom . |

*Primary Examiner*—Neil Abrams

*Attorney, Agent, or Firm*—Sughrue, Mion, Zinn, Macpeak & Seas

[57] ABSTRACT

A connector includes a housing 6 and more than two terminal groups mounted in the housing 6 and having a plurality of terminals 8 including pressing protrusions 8*b* to be pressure-contacted with a conductor pattern on each connecting portion of the cable. The connector further includes a wiring conductor 9 connected to each terminal 8 in the terminal groups for forming a desired wiring circuit in the housing, and engaging portions 10*a* provided in housing 6 for securing the housing to a cable holding portion which supports each connecting portion on the cable when engaging portions 10*a* are engaged with lock portions provided in the cable holding portion.

4 Claims, 19 Drawing Sheets

CONNECTING METHOD AND A CONNECTOR FOR FLEXIBLE PLANAR CONDUCTOR CABLES

BACKGROUND OF THE INVENTION

1. Field of the Invention

This invention relates to a connecting method and a connector for wiring and connecting, in particular cross-wiring flexible planar conductor cables.

2. Statement of the Prior Art

A flexible planar conductor cable or a flexible printed circuit (hereinafter referred to as "FPC") has a construction in which a circuit pattern is formed by attaching a conductor such as Cu or the like through an adhesive on an insulation film such as polyimide or the like and a similar insulation film is applied through an adhesive to the former film with the circuit pattern.

Such an FPC is easily wired since it is flexible and the conductors are formed in a pattern on the film. In particular, FPCs are often used to interconnect complicated circuits and devices. However, it is impossible to cross-wire an FPC so that it jumps over a circuit pattern, since it is formed with a planar shape whereby circuit design is subject to various restrictions.

For example, if a circuit design is effected to eliminate cross-wiring the circuit pattern of a portion to be connected to FPC devices are predetermined and thus the devices to be connected to the FPC must accord with the circuit pattern of the FPC. Consequently, design of devices is subject to serious limitations. Accordingly, it is necessary to effect cross-wiring on an FPC. A prior method of cross-wiring an FPC employs a jumper lead.

For convenience of explanation, an example of the prior method of cross-wiring of the FPC is described below with reference to drawings. FIG. 19A is a plan view of a cross circuit, FIG. 19(B) is a circuit pattern for carrying out the wiring of the cross circuit, and FIG. 19(C) is a partial cross sectional view of a circuit wired with a jumper lead.

In the case of designing, for example, a circuit pattern of an FPC in accordance with a wiring diagram shown in FIG. 19(A), there are three cross circuits A, B, and C. FIG. 19(B) shows a circuit pattern of conductors 3 of the FPC to realize the above circuit diagram and the jumper leads are used as shown by broken lines 3*a*, 3*b*, and 3*c*. As shown in FIG. 19(C), jumper lead 2 is disposed under FPC 1, one end of jumper lead 2 projects from connecting hole 3*e* formed in a connecting portion of Cu pattern 3, these portions are soldered by solder 4 to complete the cross-wiring.

In FIG. 19(C), 1*a* is an insulation film, and 1*b* an adhesive, and 1*c* an insulation film provided on the rear side thereof.

However, in the conventional cross-wiring using the jumper leads it is required to carry out steps of forming holes 3*e* in the connecting portion of FPC 1, inserting jumper leads 2 into holes 3*e* from the underside of the FPC, and then soldering them. Thus, it is very difficult to change the circuit pattern of the cross-wiring on account of the soldering of jumper leads 2 and the connecting portion of the FPC. It is also impossible to change the circuit pattern of the FPC conductor only by changing the circuit of the jumper leads 2 since a predetermined circuit pattern of the conductor of the FPC is formed on a portion having no cross-wiring (for example, portion 3*d* in FIG. 19(B)). Further, there is a case where the circuit pattern itself of the FPC conductor must be changed.

SUMMARY OF THE INVENTION

An object of the present invention is to provide a connecting method and a connector for the FPC which can be used to wire any pattern circuit including the cross-wiring and which allows changes in the circuit.

In order to achieve the above object, a connecting method for the FPC comprises the steps of:

- securing a connector having a plurality of connecting terminals connected to each other in a given circuit to a cable holding portion by press fitting said connector onto a connecting portion of said cable on said cable holding portion; and
- pressure-contacting each of contact portions of said connector with a conductor pattern on said connecting portion of said cable;
- whereby the flexible planar conductor cables are arranged in a given circuit.

A connector for the FPC in accordance with a first aspect of the present invention comprises:

- a housing;
- a plurality of terminal groups mounted in said housing and having protrusions to be pressure-contacted with a conductor pattern on each connecting portion of said cable;
- a wiring conductor connected to each terminal in said terminal groups for forming a desired wiring circuit in said housing; and
- engaging means provided in said housing for securing said housing to a cable holding portion which supports each connecting portion on said cable when said means are engaged with lock portions provided in said cable holding portion.

In a connector in accordance with the second aspect of the present invention in which said cable holding portion has a recess, each connecting portion on said cable is disposed along said recess, said pressing protrusions are provided on the opposite sides of housing, and said pressing protrusions of said terminals are pressure-contacted with said conductor pattern on said connecting portion of said cable when said housing is mated with said recess, thereby forming a given wiring circuit.

In accordance with the connecting method for the FPC of the present invention, it is possible to fabricate a desired wiring including the cross-wiring without using the jumper leads of the prior art, since the terminals are electrically connected to the conductor pattern on the connecting portion of the FPC when the connector having terminals with a given wiring is pressed and fixed on the connecting portion of the FPC.

The connector in accordance with the first aspect of the present invention carries out the above connecting method. Since the connector has a plurality of terminal groups with a predetermined desired wiring and engaging means which engage with the lock portion provided on the cable holding portion, it is possible to press and fix the connector to the connecting portion of the FPC held on the cable holding portion and thus to assure a wiring connection by means of fixing the connector to the holding position.

The connector in accordance with the second aspect of the present invention can assure contact of the connector with the connecting portion of the FPC as well as strengthening the fixing of the FPC to the holding position, since the connector is mated with the recess which is provided on the holding portion of the FPC and carries the FPC.

DETAILED DESCRIPTION OF THE PREFERRED EMBODIMENTS

Referring now to FIGS. 1 through 18, embodiments of a connecting method and a connector for flexible planar cables (FPC) in accordance with the present invention will be explained below.

Figure 1:
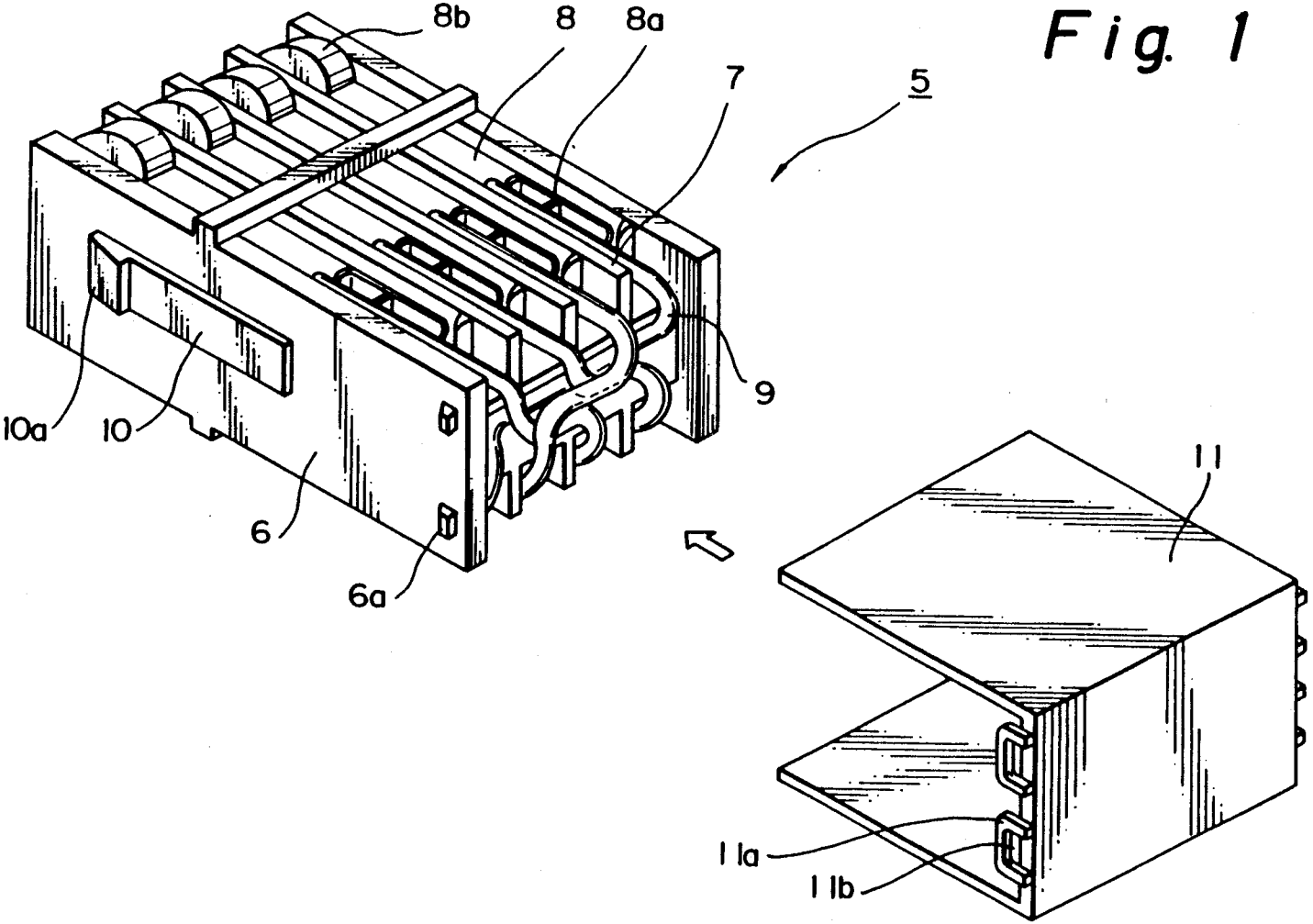
FIG. 1 is a perspective view of a first embodiment of an FPC connector in accordance with the present invention.

FIG. 1 is a perspective view of a first embodiment of an FPC connector of the present invention.

The interior of a resin housing 6 forming an FPC connector 5 is divided into eight sections each (four sections in upper and lower positions) into which each of terminals 8 is inserted.

Terminal 8 is provided with pressing portion 8*a* for pressure-contacting with wiring conductor 9 at one end thereof and with pressing protrusion 8*b* for contacting with a conductor pattern on a connecting portion of the FPC at the other end thereof.

Pressing protrusion 8*b* is formed by turning back an end of terminal 8 so that protrusion 8*b* projects outwardly from the housing. Pressing protrusion 8*b* can be electrically pressure-contacted with the conductor pattern on the connecting portion of the FPC, since protrusion 8*b* provides an action like a leaf spring.

Upper and lower four connectors construct first and second groups of terminals, respectively. Each terminal in each group is connected to each other through wiring conductors 9 covered with an insulator to form a desired circuit.

Housing 6 is provided with engaging portion 10 having protrusion 10*a* on opposite sides thereof. Protrusion 10*a* mates with engaging hole 12*b* (see FIG. 2) provided in a recess in an FPC holding portion mentioned below.

A housing cover is generally designated by reference number 11. When housing cover 11 is pushed toward housing 6 as shown by an arrow, lock hole 11*b* in lock portion 11*a* provided on each side of housing cover 11 engages with lock projection 6*a* on housing 6, so that cover 11 is secured to housing 6. Housing cover 11 not only improves the appearance of FPC connector 5 but also prevents dust from entering into the interior of housing 6, thus maintaining a good electrical connection. However, housing cover 11 is not essential to FPC connector 5.

Figure 2:
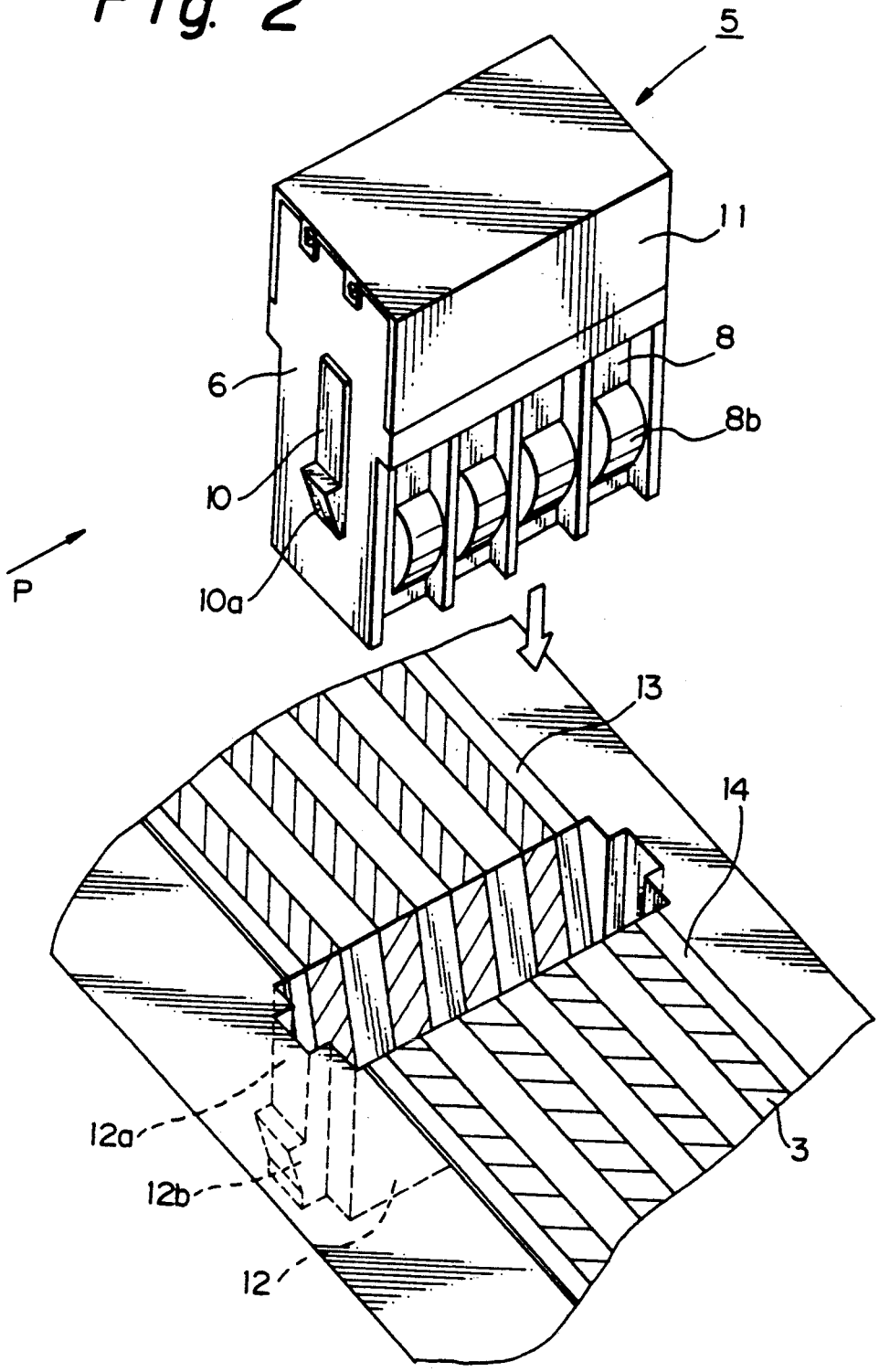
FIG. 2 is a perspective view illustrating the FPC connector which is being secured to a base.

As shown in FIG. 2, the FPC holding portion on a device using the FPC is provided with recess 12 which is adapted to receive a lower portion of FPC connector 5. Connecting ends 13*a* and 14*a* (see FIG. 3) of first FPC 13 and second FPC 14 are disposed along recess 12. insulator films of the connecting ends are stripped from the FPCs to expose conductor patterns 3.

Recess 12 is provided with guide grooves 12*a* on the opposite sides thereof. Guide groove 12*a* is provided with lock hole 12*b* shown by a broken line in FIG. 2 at a lower portion thereof.

When engaging portion 10 of FPC connector 5 is inserted into guide groove 12*a* and protrusion 10*a* is engaged with lock hole 12*b*, the FPC connector is securely fixed in recess 12.

Figure 3:
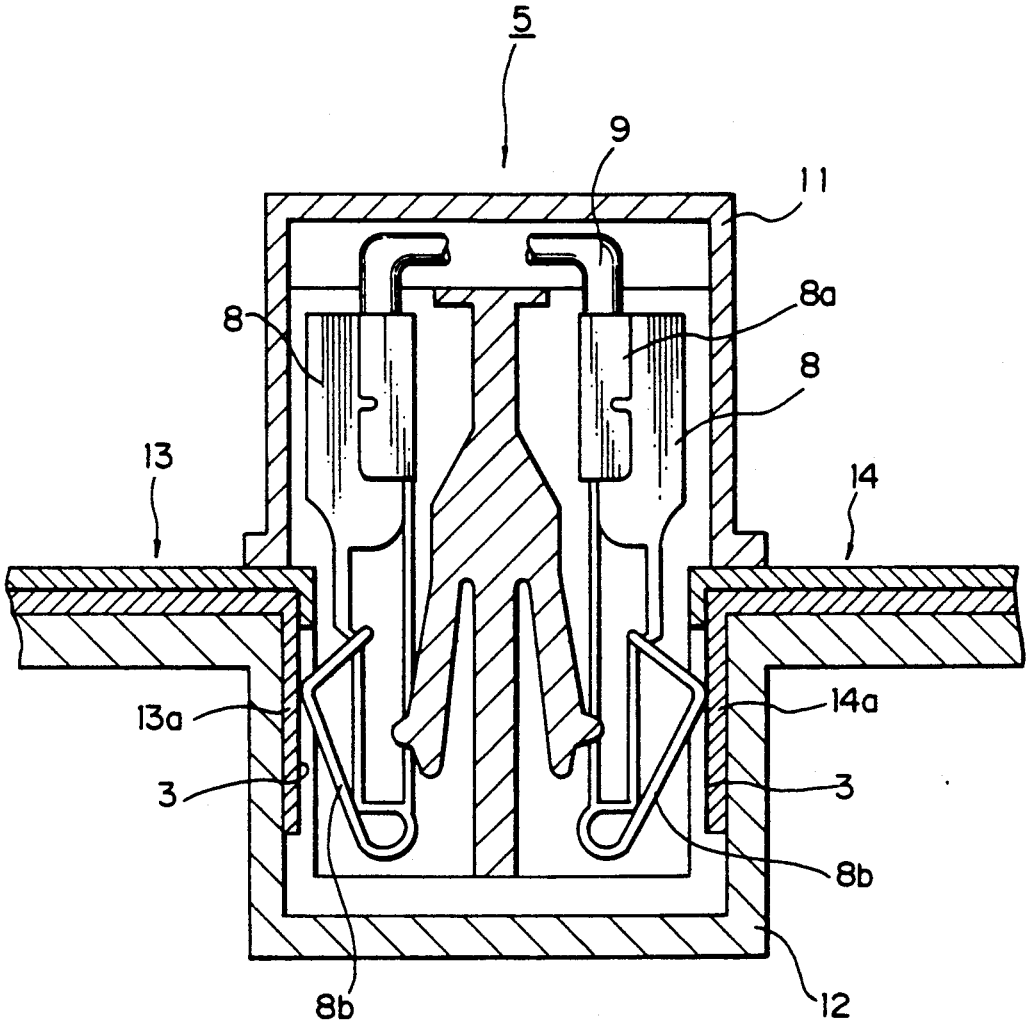
FIG. 3 is a cross sectional view of the FPC and the FPC connector of FIG. 1 secured to the FPC.

FIG. 3 is a cross sectional view of connector 5 mounted in recess 12 shown by arrow P in FIG. 2.

Each of conductor patterns 3 on first FPC 13 is contacted with each of pressing protrusions 8*b* of terminals 8 in the first group, connected to each of pressing protrusions 8*b* of terminals 8 in the second group through each of wiring conductors 9, and connected to each of conductor patterns 3 on the second FPC contacted with pressing protrusion 8*b*.

Thus, it is possible to securely maintain an electrical contact unless connector 5 is removed from recess 12. Therefore, even if connector 5 is subject to an external force such as vibration or the like, since pressing protrusions 8*b* of terminals 8 in the opposited groups can pressure-contact the conductor patterns on FPCs 13 and 14 with protrusions 8*b* pushing with each other in connector 5 mounted in the recess provided in the cable holding portion of the FPC.

Further, it is possible to easily change a circuit by removing housing cover 11 from connector 5, removing old wiring conductors 9 from pressing portions 8*a*, and attaching new wiring conductors 9 to pressing portions 8*a*, since the opposite ends of wiring conductors 9 are merely clamped between protrusions 8*a*, as described above.

Figure 4:
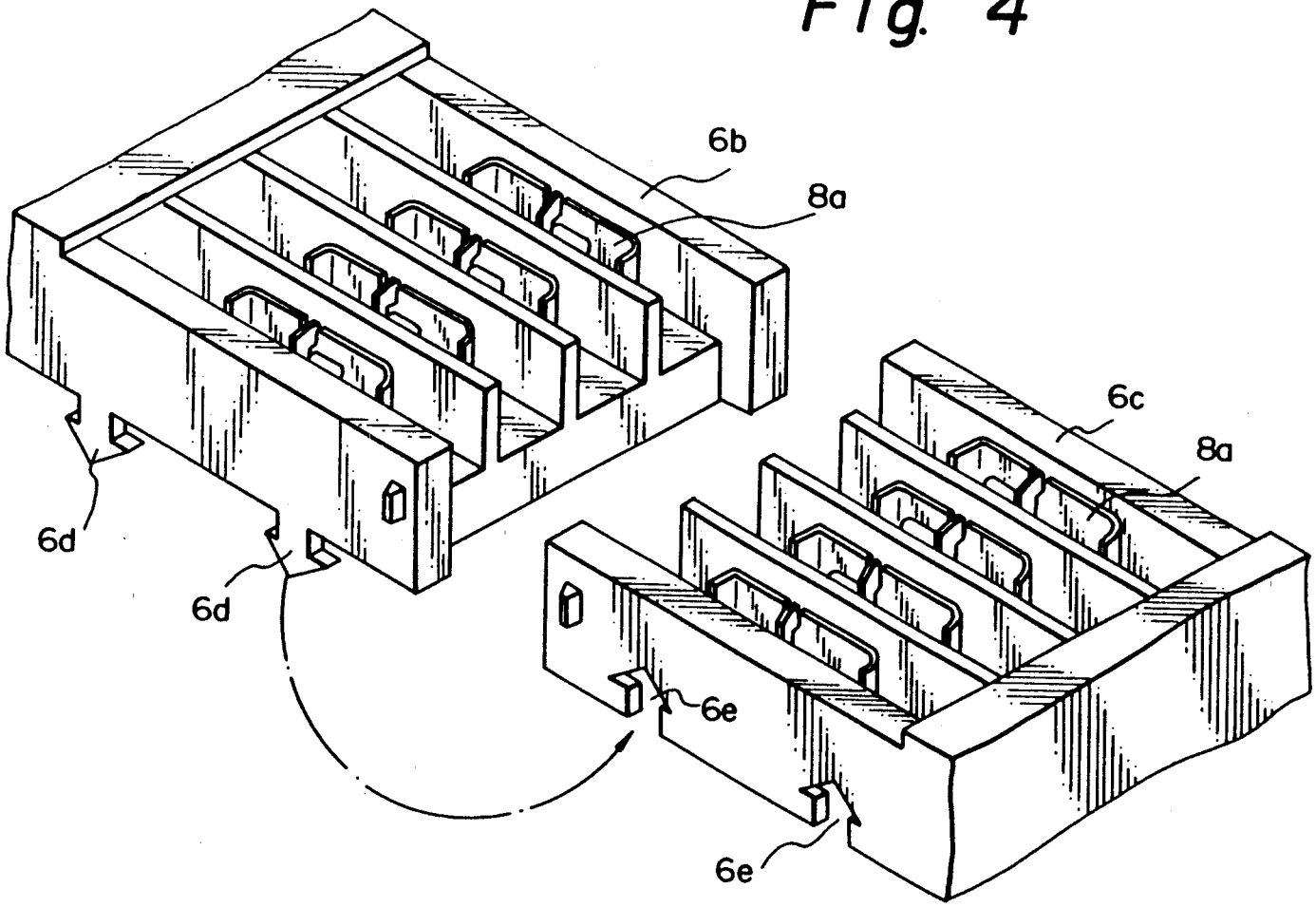
FIG. 4 is a perspective view of a housing of the FPC connector, having two blocks.

In the case of producing a great quantity of such FPC connectors 5, insertion by means of wiring conductors 9 into the pressing portions is inefficient. In this case, housing 6 may be divided into upper housing member 6*b* and lower housing member 6*c* as shown in FIG. 4 (In the drawing, the other ends and interior of the members are not shown for the convenience of explanation.). If both housing members 6*b* and 6*c* are put on a belt conveyor, a production line or the like with the top ends of the members being confronted with each other, a connecting operation to be carried out by machine will be greatly simplified. Thus, automation of wiring will be readily achieved, and the production costs will be substantially lowered. After wiring, two housing members 6*b* and 6*c* are confronted with each other, lock projections 6*d* on one member 6*b* are engaged with lock holes 6*e* on the other member 6*c*, and housing cover 11 is attached to housing 6.

Figure 5:
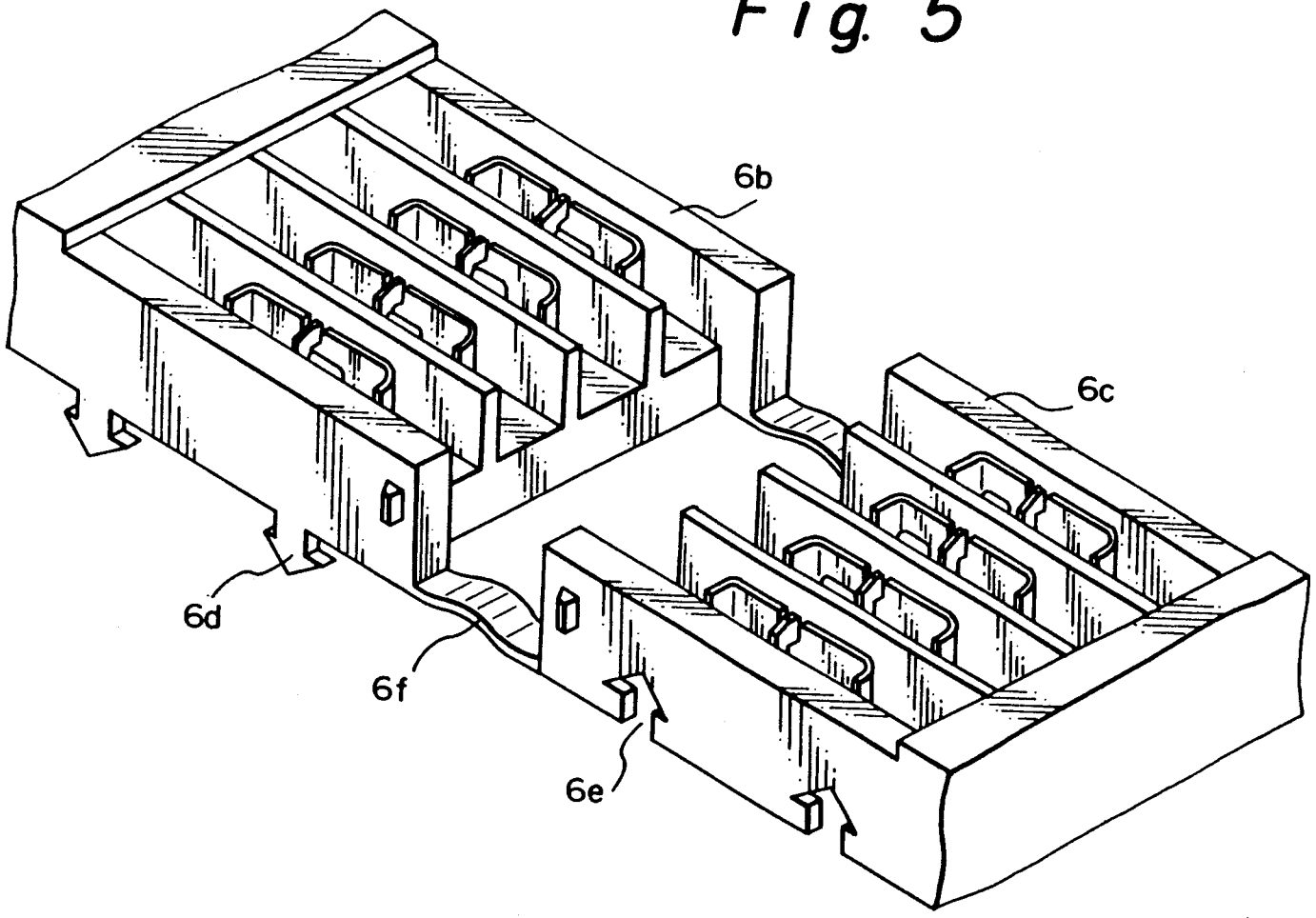
FIG. 5 is a perspective view of a housing of the FPC connector, two blocks of which are coupled with each other by hinges.

The two housing members 6*b* and 6*c* are not separated from each other as shown in FIG. 4, but may be connected to each other by hinges 6*f* integrally formed therein as shown in FIG. 5. This construction prevents the two members from moving out of position during wiring on the production line and enable easy mating of members 6*b* and 6*c* with each other.

It is possible to obtain the following embodiment by changing terminals 8 and wiring conductors 9.

Elements designated by the same reference numbers as those in FIG. 1 through 5 are not explained in the following embodiment.

Figure 6:
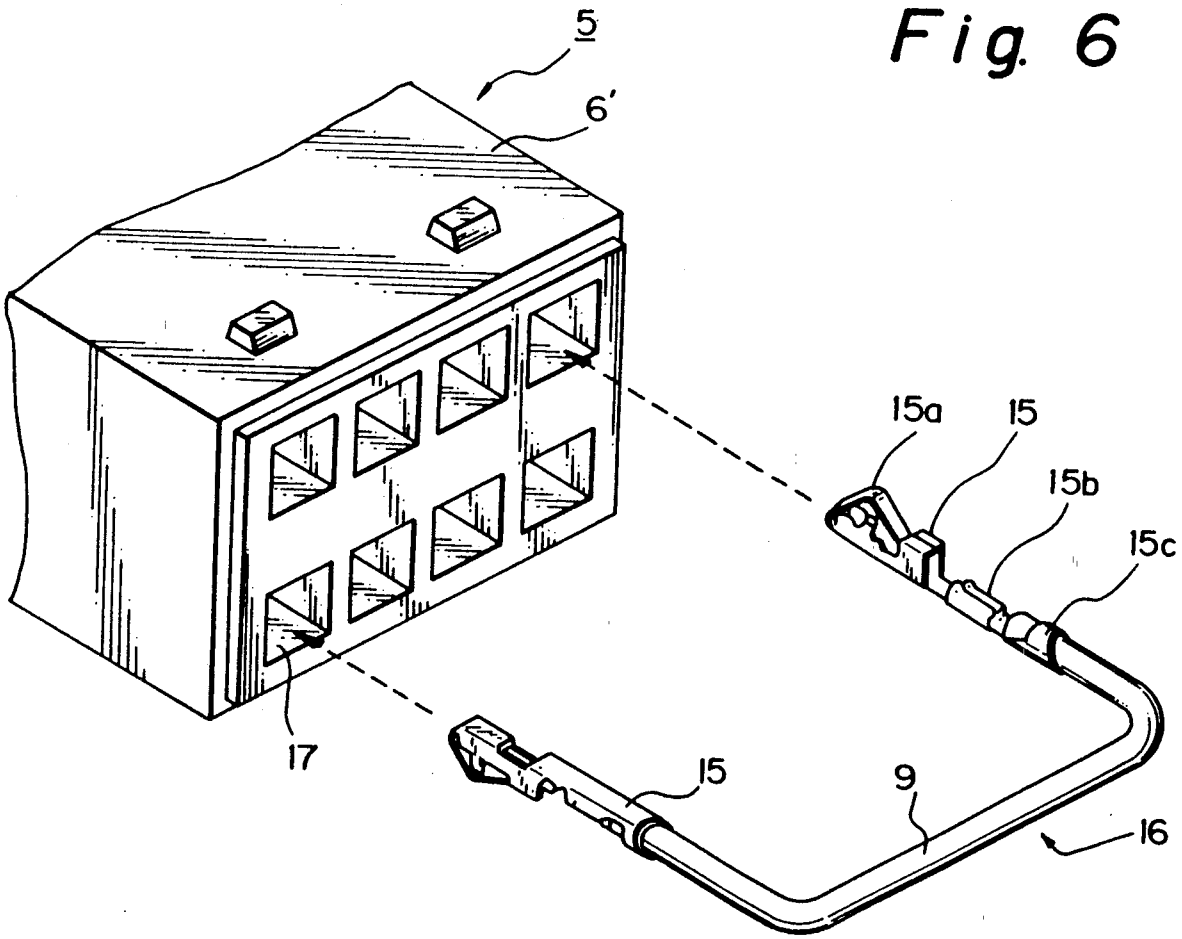
FIG. 6 is a perspective view of a second embodiment of the FPC connector in accordance with the present invention.
Figure 7:
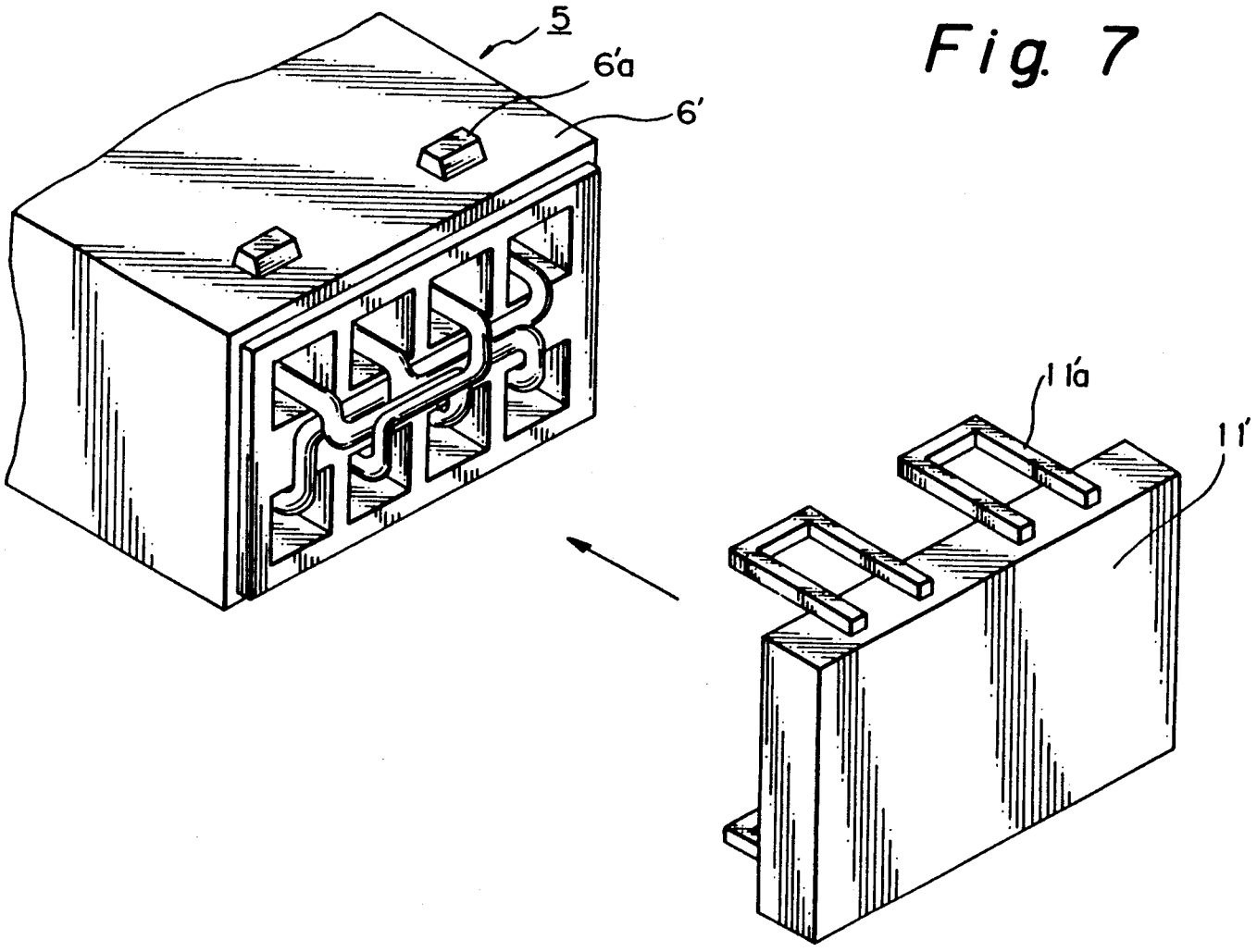
FIG. 7 is a perspective view of the connector of FIG. 6 and a housing cover to be attached to the connector.

FIGS. 6 and 7 illustrate a second embodiment of the present invention.

In FIG. 6, terminal 15 includes pressing protrusion 15*a*, pressing portion 15*b*, and fixing piece 15*c*. One end of wiring conductor 9 is connected to pressing portion 15*b* by bending portion 15*b* inwardly and wiring conductor 9 is secured to terminal 15 by bending fixing piece 15*c* inwardly so that conductor 9 does not slip out of terminal 15. The other end of wiring conductor 9 is connected to another terminal 15 in the same manner to form a pair of circuit terminals 16. Four pairs of the circuit terminals 16 are inserted into eight mating bores 17 formed in housing 6' of FPC connector 5 to form a predetermined circuit (FIG. 7).

Then, as shown in FIG. 7, housing cover 11' is put on the top of housing 6' and secured to it by engaging lock portions 11'*a* of cover 11' with lock protrusions 6'*a* of housing 6'.

In this embodiment, it is possible to readily change the circuit pattern by removing housing cover 11' from housing 6' and displacing the circuit terminals 16 to another mating bore.

Figure 8:
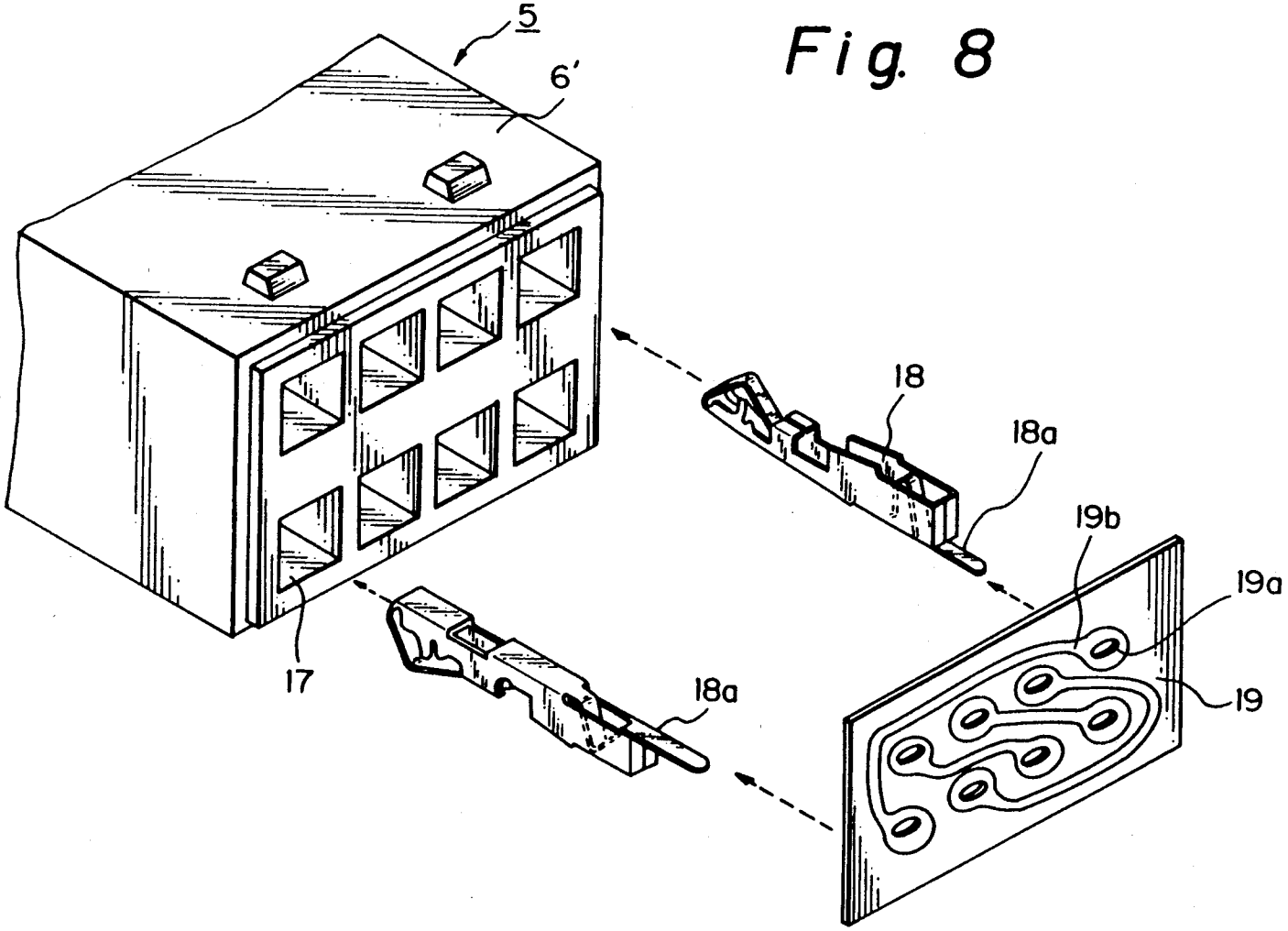
FIG. 8 is a perspective view of a third embodiment of the FPC connector in accordance with the present invention.
Figure 9:
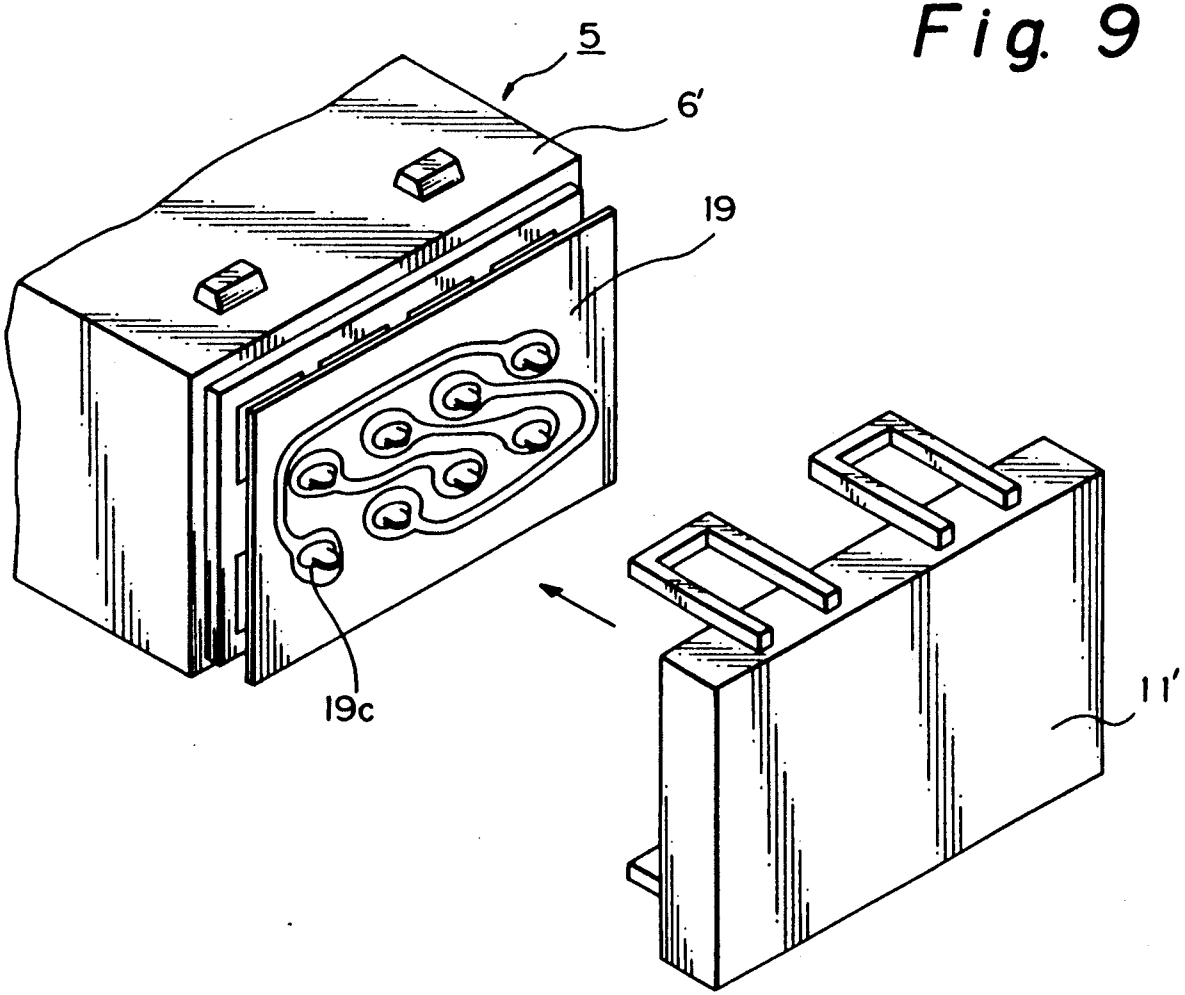
FIG. 9 is a perspective view of the connector of FIG. 8 and the housing cover to be attached to the connector.

FIGS. 8 and 9 show a third embodiment of the present invention.

Each of terminals 18 has a tongue 18*a* which is adapted to be inserted into a corresponding connecting bore 19*a* in printed base plate 19. Printed base plate 19 has provided on the surface printed wiring 19*b* which connects each of the connecting bores 19*a* to form a desired circuit. After soldering the tongue 18*a* in connecting bores 19*a* by means of solder 19*c*, terminals 18 are inserted into mating bores 17 and as shown in FIG. 9, housing cover 11' is attached to the housing in the same manner as shown in FIG. 7. Alternately, printed base plate 19 may be soldered to terminals 18 after inserting terminals 18 into mating bores 17.

In this case, it is not necessary to arrange all wiring conductors 9 in the manner shown in FIGS. 1 and 6 and there is no danger of wiring being mistaken, since the desired circuit patterns are formed beforehand on the printed base plate.

When the circuit is to be changed, the old printed base plate 19 may be exchanged to a new one 19 after melting the solder 19*c* or the old printed base plate 19 with terminals 18 may be exchanged for a new one 19 with terminals being soldered thereon previously.

Figure 10:
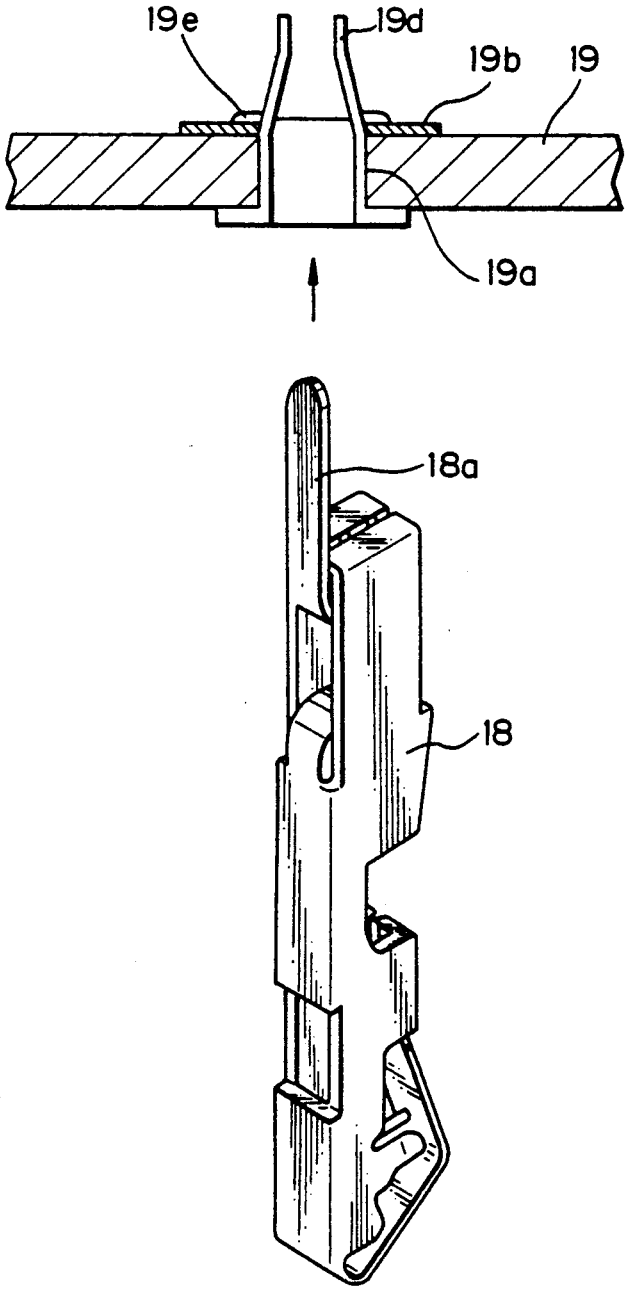
FIG. 10 is a perspective view of a relay terminal to be coupled to a connecting hole in a printed base plate in the third embodiment of FIG. 8.

If relay metal 19*d* is fixed in connecting bore 19*a* in printed base plate 19 by solder 19*e* as shown in FIG. 10, tonque 18*a* of terminals 18 can be detachably connected to printed base plate 19. Consequently, exchange of printed base plate 19 becomes easy and alternation of the circuit can be carried out readily if printed base plates having different circuit patterns are provided previously.

Also, an FPC having a given circuit may be used instead of printed base plate 19. In this case, it is not necessary to precisely position the connecting bores to receive tongue 18*a* since the FPC is flexible and it is possible to smoothly insert terminals 18 into mating bore 17 without receiving any resistance, even if tonque 18*a* is soldered in a connecting bore in the FPC.

Figure 11:
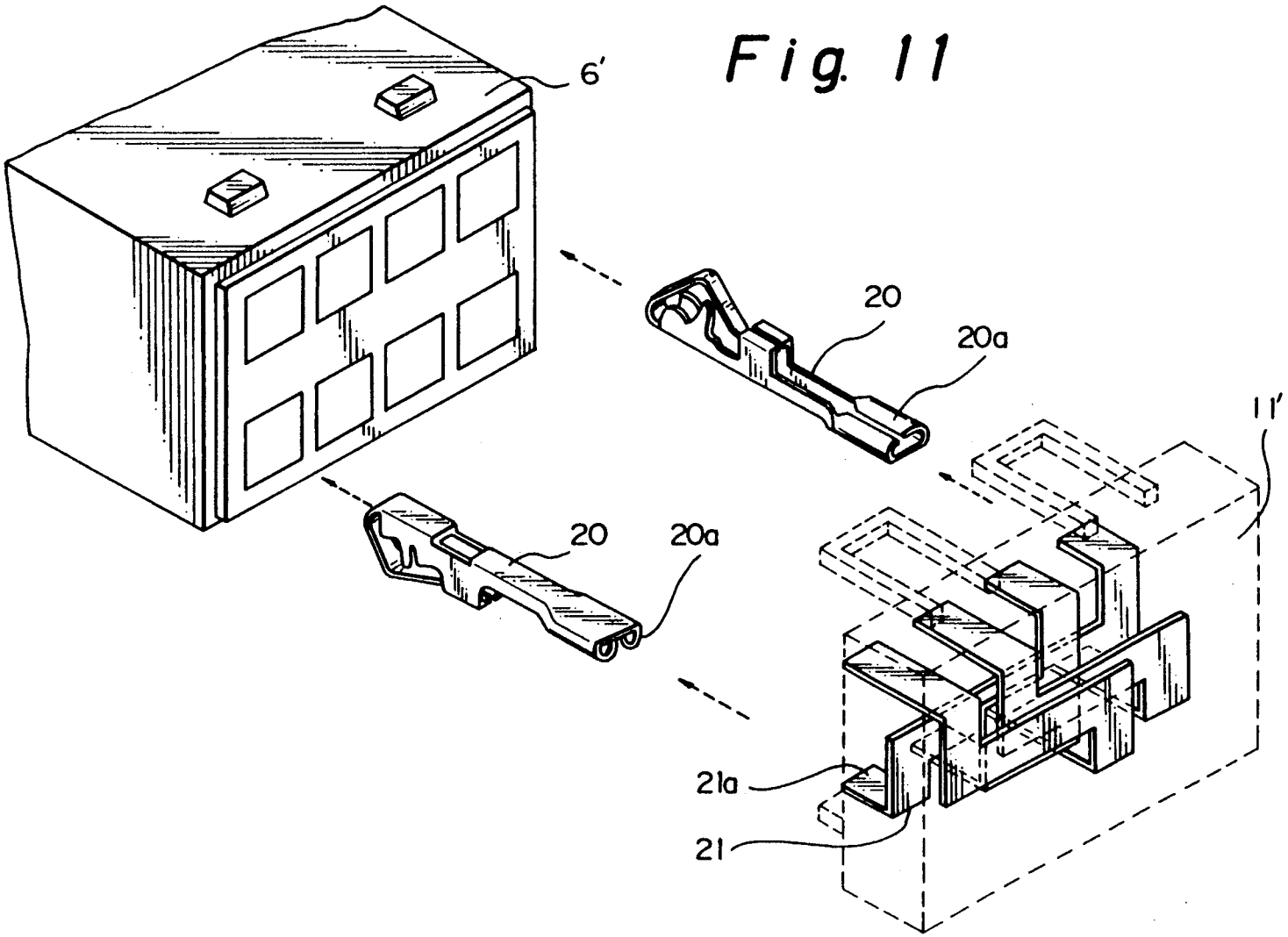
FIG. 11 is a perspective view of a fourth embodiment of the FPC connector in accordance with the present invention.

FIG. 11 shows a fourth embodiment of the present invention.

Terminal 20 is provided with pressing portion 20*a* at one end thereof. A desired circuit formed by metal plates 21 of copper of the like are arranged in housing cover 11' shown by broken lines. End 21*a* of metal plate 21 is inserted into and secured to a clearance in pressing portion 20*a* when housing cover 11' is put on housing 6'.

In this embodiment, it is possible to change the circuit by a simple operation of exchanging old housing cover 11' for a new one with a different circuit being formed by metal plate 21, if many housing covers 11' having different circuits are previously prepared.

Figure 12:
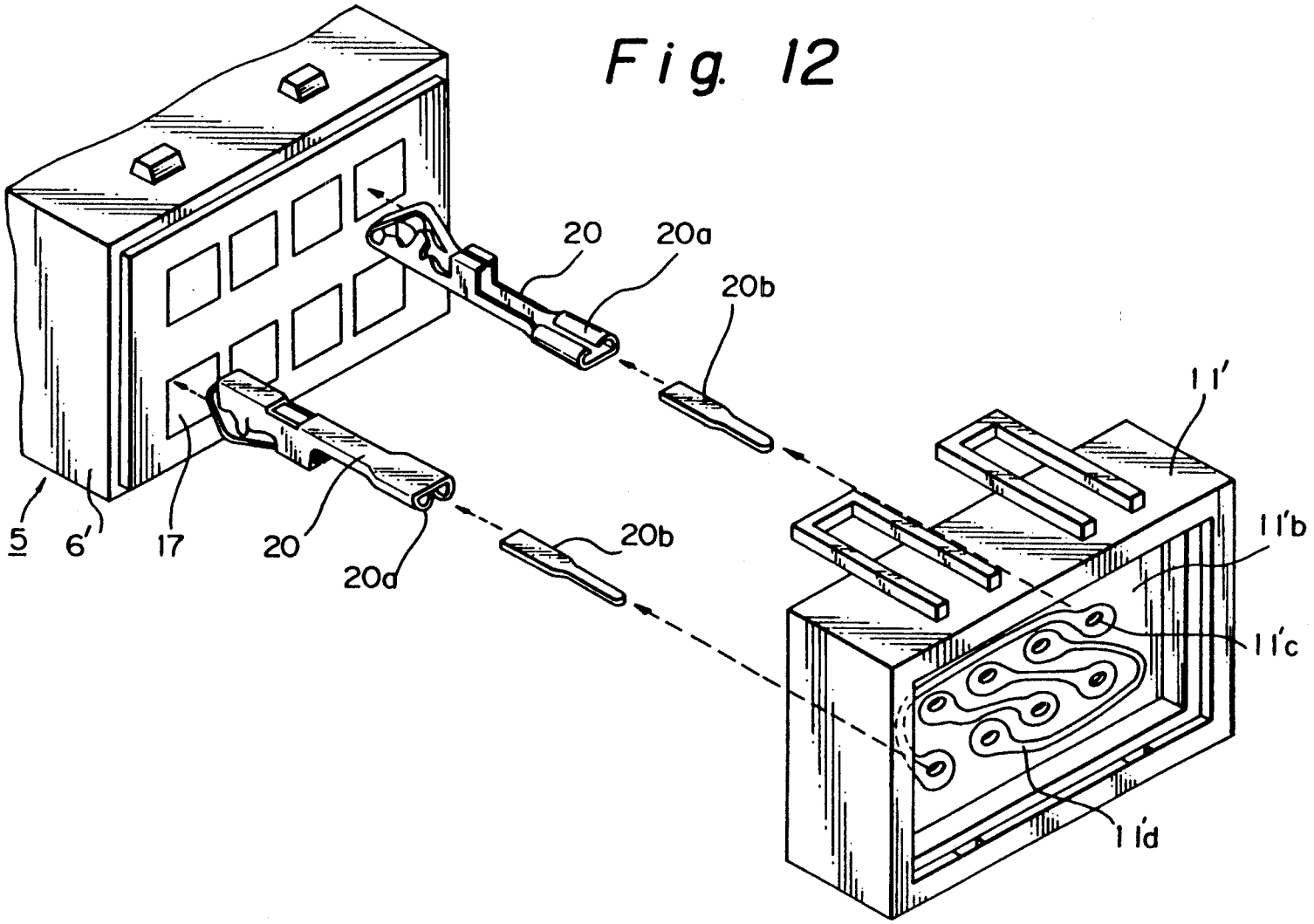
FIG. 12 is a perspective view of a fifth embodiment of the FPC connector in accordance with the present invention.
Figure 13:
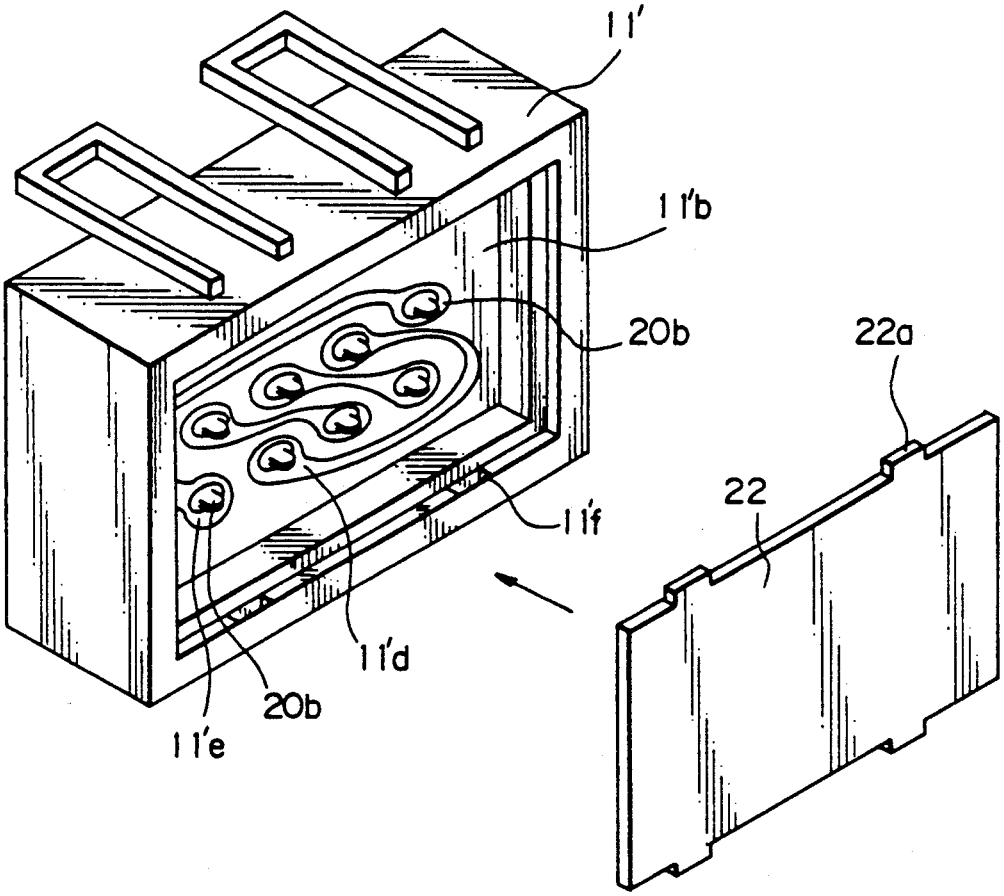
FIG. 13 is a perspective view of the housing cover of FIG. 12 and a cover to be attached to the housing cover.

FIGS. 12 and 13 show a fifth embodiment of the present invention.

Housing cover 11' is provided with middle partition 11'*b* which has connecting bores 11'*c* at the respective positions corresponding to those of the respective terminals. Plated lines 11'*d* are formed on the surface of middle partition 11'*b* so that the plated lines connecting bores 11'*c* with each other form a given circuit.

As shown in FIG. 13, after inserting relay terminal 20*b* into connecting bores 11'*c* and soldering them by means of solder 11'*e*, cover 22 is attached to the housing cover 11' with protrusions 22*a* of cover 22 being engaged with lock holes 11'*f* formed in the interior of housing cover 11'.

After inserting the relay terminals 20*b* into the pressing portions 20*a* of terminals 20, terminals 20 are inserted into the mating bores 17 in housing 6'. Alternately, after inserting terminals 20 into the mating bores 17, relay terminals 20*b* may be inserted into pressing portions 20*a* of terminals 20 by pushing housing cover 11 onto housing 6'.

This embodiment has not only an advantage in which an alternation of circuit can be readily effected by exchanging housing covers 11' in the same manner as in the fourth embodiment shown in FIG. 11 but also an advantage in which an internal circuit can be made easier than the fourth embodiment.

Figure 14:
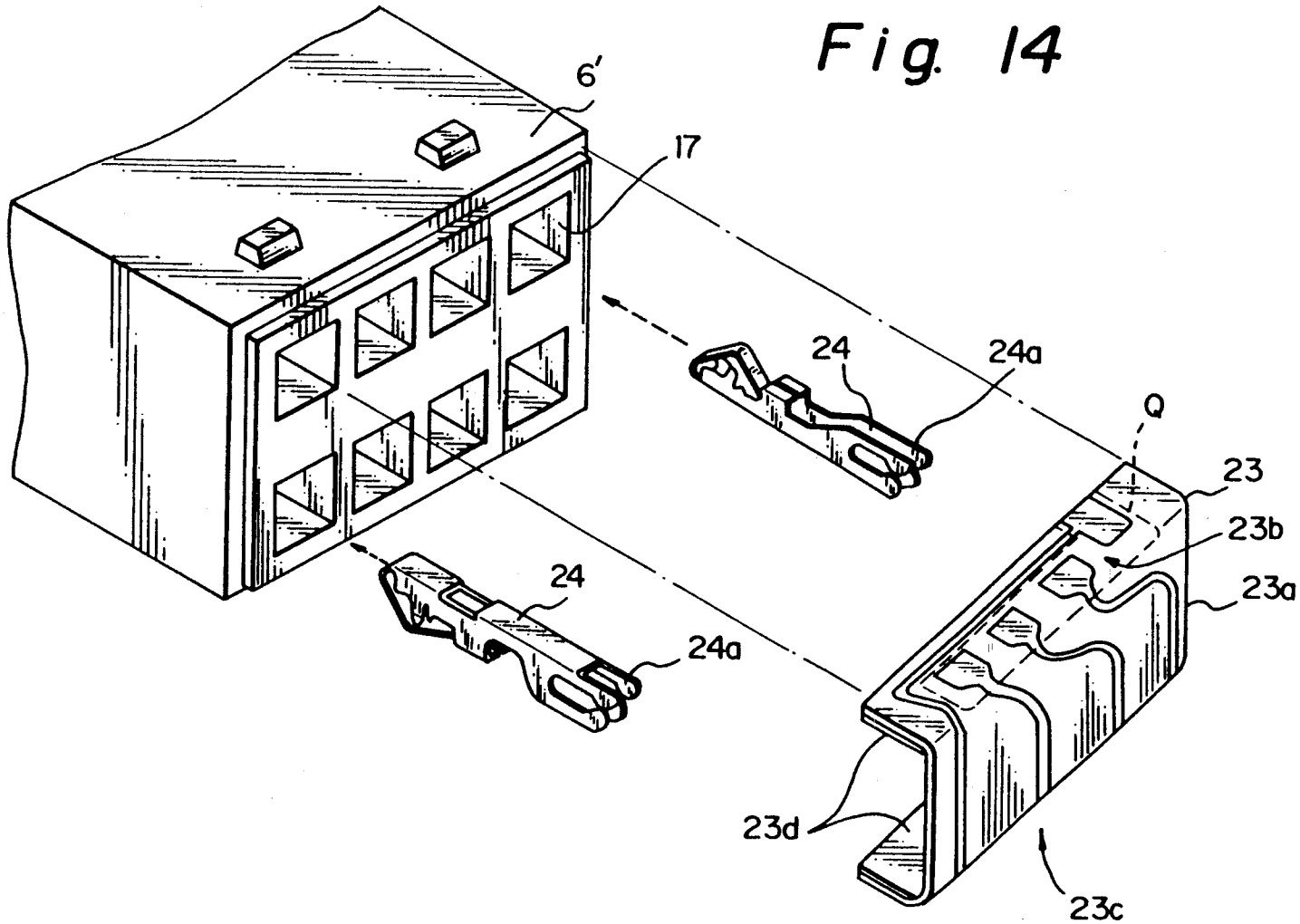
FIG. 14 is a perspective view of a sixth embodiment of the FPC connector in accordance with the present invention.

FIG. 14 shows a sixth embodiment of the present invention.

A circuit is formed in conductor pattern 23*a* on FPC 23. An insulator film is removed from only the surface on connecting portion 23*b* encircled by broken line Q. A similar connecting portion 23*c* (not shown) is formed on the other end of FPC 23. Reinforcing plates 23*d* are secured to rear sides of connecting portions 23*d* and 23*c* by an adhesive.

On the other hand, a clamping portion 24*a* is provided on one end of terminal 24. After inserting terminals 24 into mating bores 17 in the housing 6', the terminals 24 are inter connected in a given circuit by inserting connecting portions 23*b*, 23*c* together with reinforcing plates 23*d* into clamping portions 24*a* of terminals 24 so that portions 24*a* are electrically connected to conductor pattern 23*a*. A housing cover in this embodiment is the same as that 11' of FIG. 7 or 9, so it is not shown in FIG. 14.

According to this embodiment, it is not necessary to effect a troublesome operation such as soldering the terminal 24 on the circuit pattern and it is possible to change a circuit by exchanging FPC 23 which has already been prepared to have different circuit patterns.

The above embodiments adopt a method of mating FPC connector 5 with recess 12 (see FIG. 2) formed in the connecting portion of the FPC. However, there is a case when it is difficult to form recess 12 in the portion due to an attaching portion of FPCs 13 and 14.

An embodiment of an FPC connector in this case is explained below.

Figure 15:
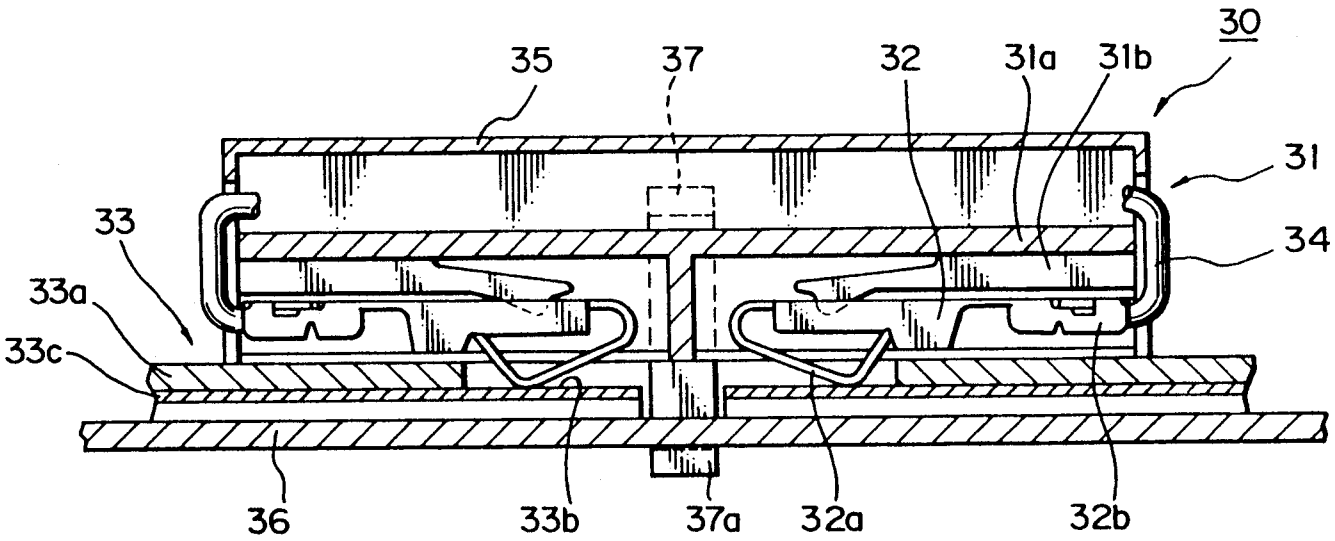
FIG. 15 is a cross sectional view of a seventh embodiment of the FPC connector in accordance with the present invention.
Figure 16:
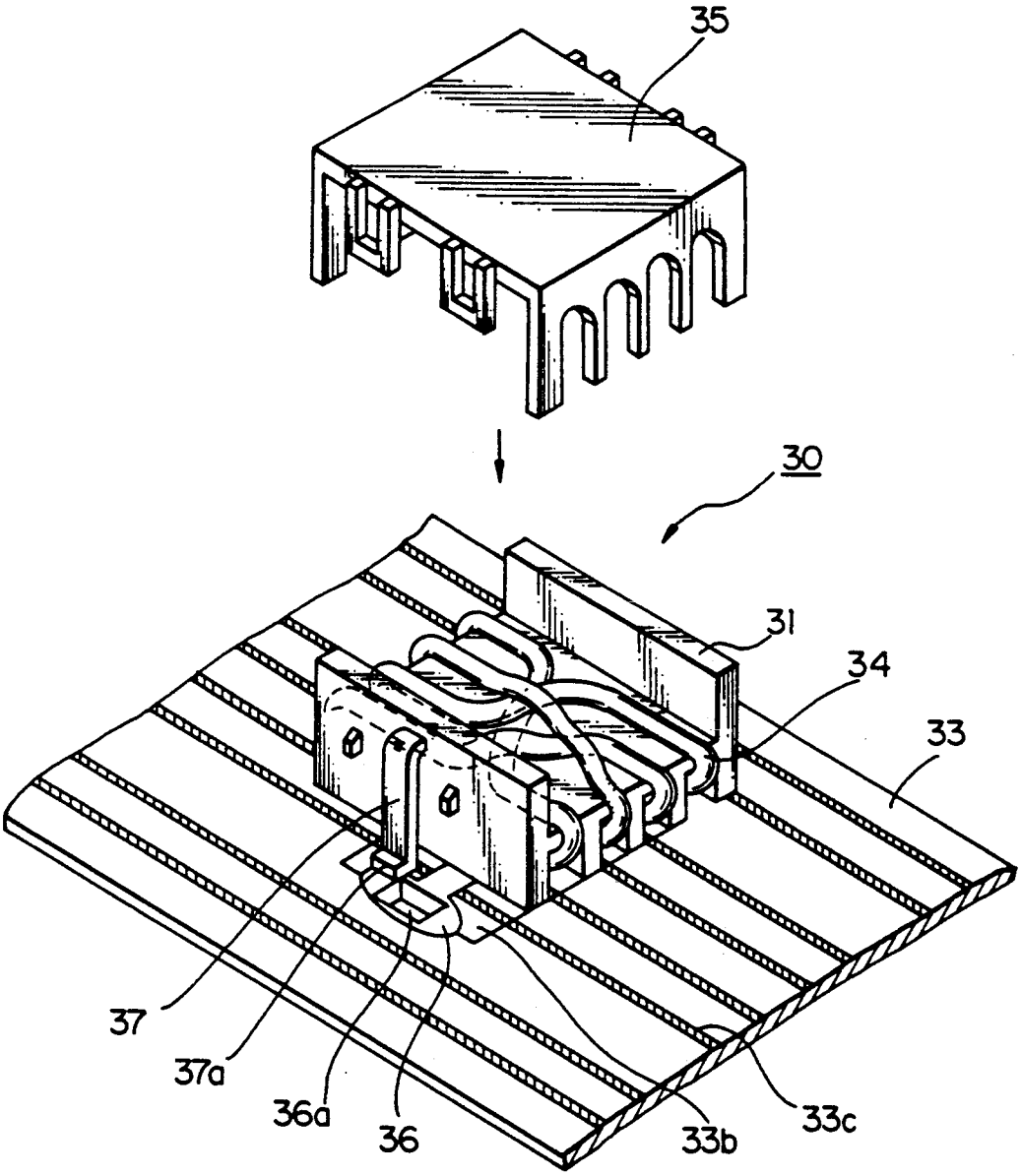
FIG. 16 is a perspective view of the FPC connector of FIG. 15 to be secured to a base.

FIG. 15 shows a cross sectional view of a main portion of a seventh embodiment of the FPC connector in accordance with the present invention and FIG. 16 shows a perspective view of the seventh embodiment.

As shown in FIG. 15, this embodiment is characterized in that terminal 32 is disposed horizontally with respect to FPC 33.

Terminal 32 is horizontally supported on support piece 31*b* below partition plate 31*a* in housing 31 of FPC connector 30. Pressing protrusion 32*a* having elasticity presses conductor pattern 33*c* on connecting portion 33*b* which is exposed by stripping insulator film 33*a* from the surface of FPC 33.

Terminal 32 is also provided with pressing portion 32*b* at the other end opposite to pressing protrusion 32*a*. Wiring conductor 34 is pressure-contacted with pressing portion 32*b* so that wiring conductors 34 interconnect terminals 32 in right and left terminal groups to form a given circuit.

In FIG. 15, reference 35 is a housing cover hanging over the top of housing 31 and reference 36 is a base for securely supporting FPC 33.

As shown in FIG. 16, the housing 31 is provided with fixing arms 37 at the opposite sides thereof. Fixing arm 37 is provided with lock protrusion 37*a* at a free end thereof.

On the other hand, base 36 is provided with fixing holes 36*a*. When fixing arm 37 is inserted into fixing holes 36*a*, lock protrusion 37*a* engages with the rear side of base 36, so that FPC connector 30 is securely fixed on base 36.

Thus, FPC 33 is secured to base 36 and terminals 32 are electrically connected to conductor pattern 33*c* on the connecting portion 33*b*.

Figure 17:
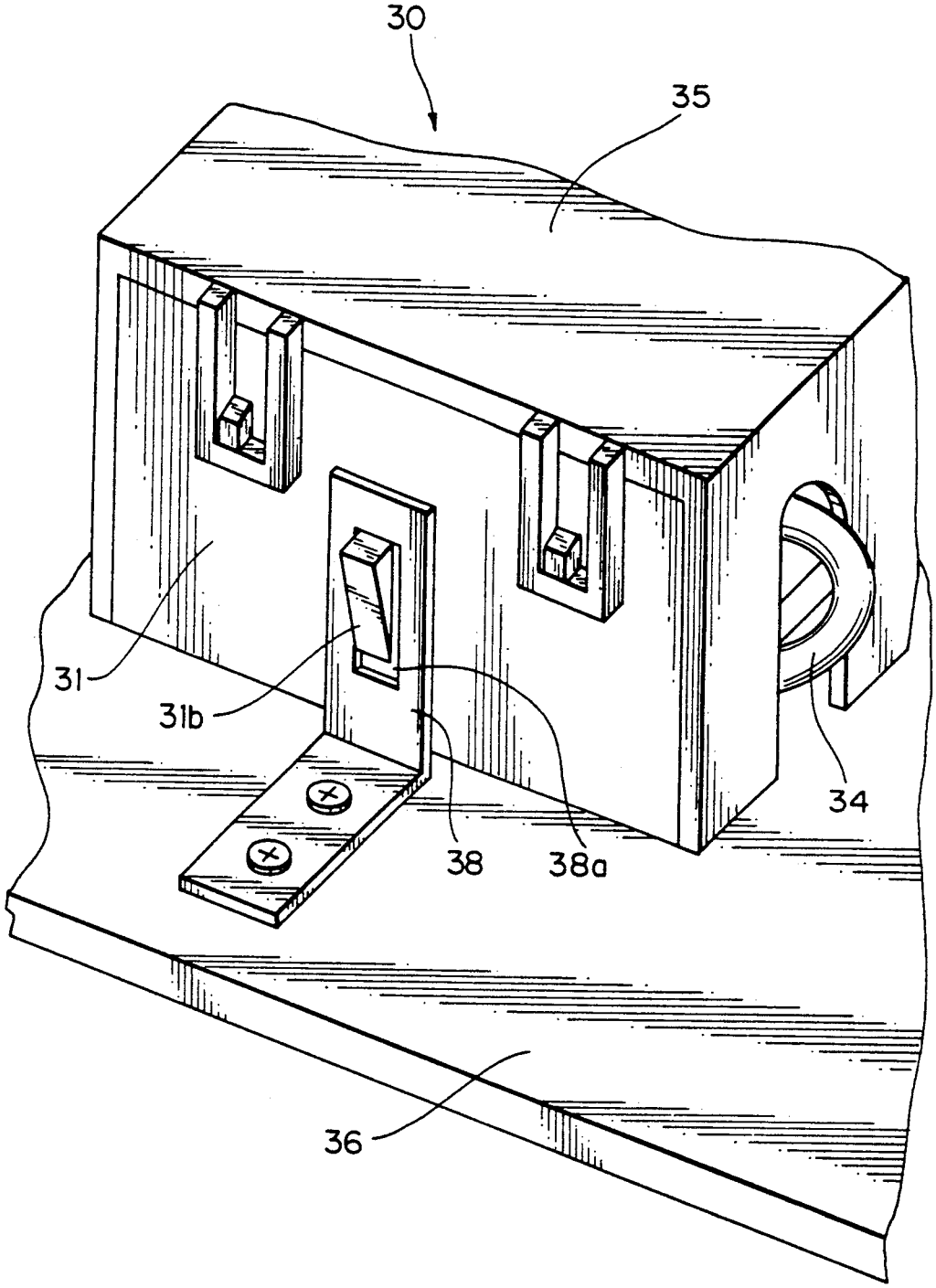
FIG. 17 is a perspective view of the FPC connector of FIG. 15 to be secured to a base in another manner.

If it is impossible to form the fixing holes in base 36, engaging member 38 may be attached to base 36, and the support pieces 31*b* provided on opposite sides of housing 31 may be engaged with lock holes 38*a*, as shown in FIG. 17. For convenience of explanation, FPC 33 is not shown in FIG. 17.

Figure 18:
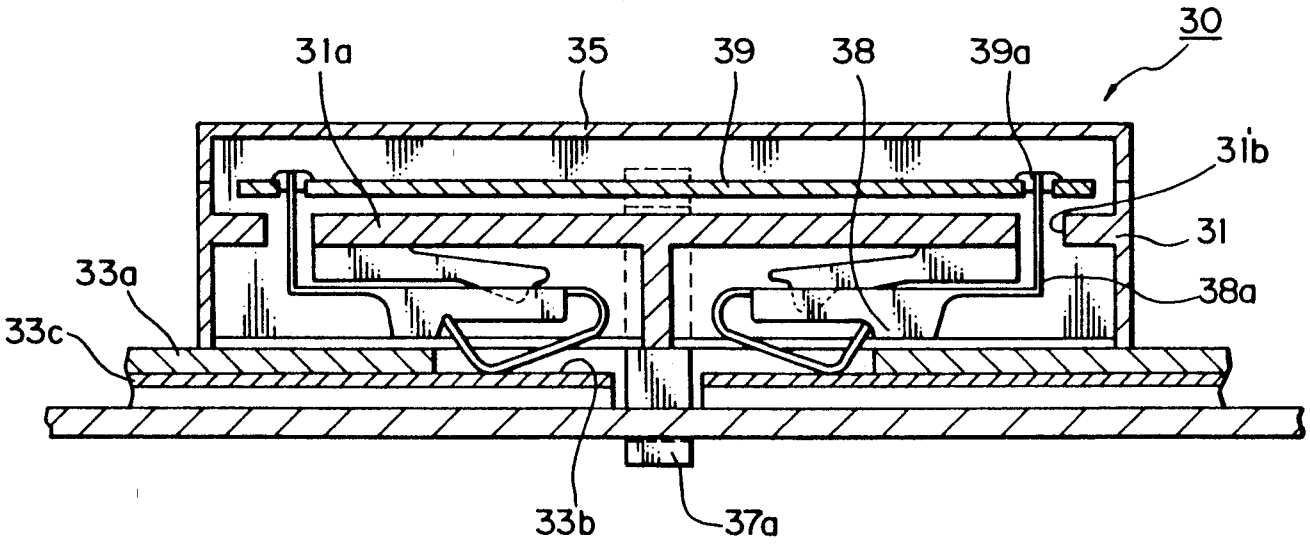
FIG. 18 is a cross sectional view of an eighth embodiment of the FPC connector.
Figure 19A:
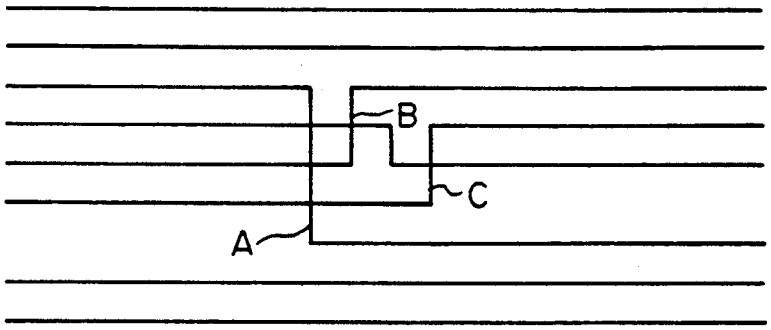
Fig. 19(A) PRIOR ART
FIGS. 19A, B and C show a prior method of cross-wiring of an FPC, FIG. 19(A) being a plan view of a cross circuit.
Figure 19B:
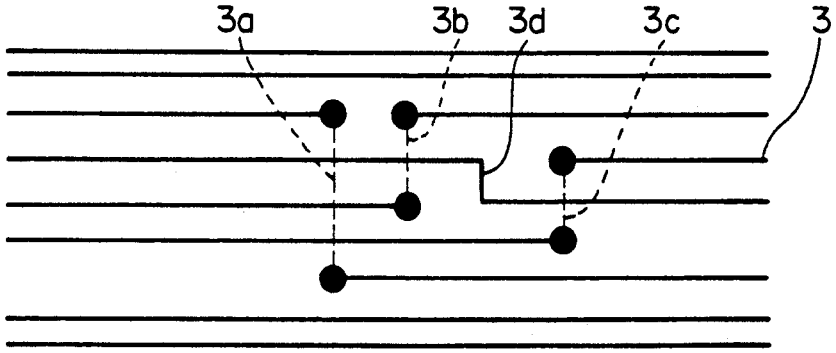
Fig. 19(B) PRIOR ART
FIG. 19(B) being a circuit pattern for carrying out the wiring of the cross circuit.
Figure 19C:
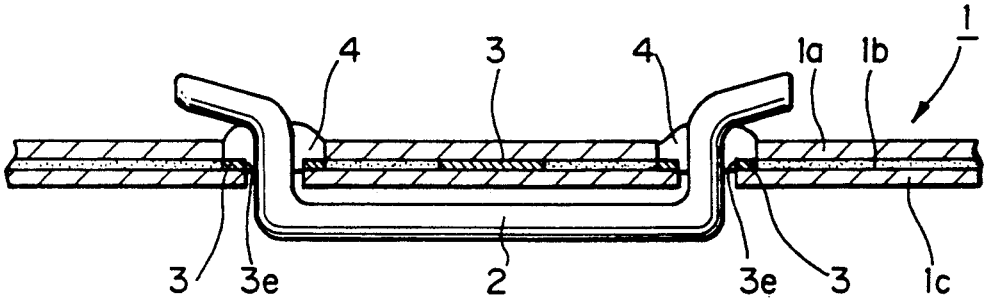
Fig. 19(C) PRIOR ART
FIG. 19(C) being a partial cross sectional view of a circuit wired with a jumper lead.

FIG. 18 shows an eighth embodiment of the present invention.

This embodiment is characterized in that one end of terminal 38 is bent upwardly so that the end projects through partition plate 31*a* in order to substitute a printed base plate for the circuit wiring in the seventh embodiment shown in FIG. 15. That is, connecting portion 38*a* of terminal 38 is bent upwardly so that it passes through a hole 31'*b* in partition plate 31*a* and also it is inserted into connecting hole 39*a* in printed base plate 39 on which a given pattern circuit (not shown) is formed. Portion 38*a* is soldered in hole 39*a* to form a desired wiring.

The alternation of the circuit wiring described in the embodiments referred to FIGS. 10, 11, and 14 can be applied to the eighth embodiment.

Although the above embodiments are referred to the connection of two FPCs, it is possible to interconnect four FPCs in a given circuit if the terminal groups are provided on the respective sides of a rectangular cross section of the housing and the respective groups press the connecting portions of the respective FPCs.

In addition, it is possible to interconnect the desired numbers of the FPCs, if a pair of sides of the housing in one direction are made longer than the other and a plurality of terminal groups are provided on the sides.

In the present invention, means for fixing the FPC connector on the base are not limited to the means related to the above embodiments but include known practical means.

In accordance with the present invention, it is possible to eliminate the conventional troublesome process of wiring the FPC by using the jumper leads, since it is possible to effect any desired wiring including the cross-wiring only by pressure-contacting the terminals in the groups having a desired wiring therein with the connecting portion on the FPC and by fixing the locking means provided on the connector on the locking portion of the base; it is possible to easily change the wiring by changing the wiring circuit formed in the connector or by exchanging the connector itself; and it is possible to fix the FPC at a given position simultaneously with wiring of the FPC.

Further, it is possible to strengthen the fixing of the FPC on the given position by arranging the FPC on the recess formed in the given position and mating the connector with the recess; and it is also possible to assure the electrical contact of the connecting portions of the FPC and the connector.

What is claimed is:

1. A connector for forming a predetermined wiring circuit on a flexible planar conductor cable, comprising:

a housing;

a plurality of terminal groups mounted in said housing and having pressing protrusions to be pressure-contacted with a conductor pattern provided on a connecting portion of said cable;

a wiring conductor connected to each terminal of said plurality of terminal groups for forming a predetermined wiring circuit in said housing; and engaging means provided in said housing for securing said housing to a cable holding portion of said cable, said engaging means being engaged with lock portions provided on said cable holding portion, wherein said cable holding portion comprises a recess, said connecting portion on said cable is disposed within said recess, and said pressing protrusions are provided on opposite sides of said housing, whereby said pressing protrusions of said terminals are pressure-contacted with said conductor pattern on said connecting portion of said cable when said housing is mated with said recess, thereby forming the predetermined wiring circuit.

2. A connector according to claim 1, wherein said wiring conductor comprises a wiring lead.

3. A connector according to claim 1, wherein said wiring conductor comprises a printed base plate.

4. A connector according to claim 1, wherein said wiring conductor comprises a metal plate.

* * * * *